US009499979B2

(12) United States Patent
Huang

(10) Patent No.: US 9,499,979 B2
(45) Date of Patent: Nov. 22, 2016

(54) INTERLOCKING MODULAR FLOOR TILE

(75) Inventor: Huanwen Huang, Guangdong (CN)

(73) Assignee: Huanwen Huang, Guangdong (CN)

( * ) Notice: Subject to any disclaimer, the term of this patent is extended or adjusted under 35 U.S.C. 154(b) by 0 days.

(21) Appl. No.: 13/519,063

(22) PCT Filed: Aug. 27, 2010

(86) PCT No.: PCT/CN2010/001304

§ 371 (c)(1),
(2), (4) Date: Sep. 10, 2012

(87) PCT Pub. No.: WO2011/075933

PCT Pub. Date: Jun. 30, 2011

(65) Prior Publication Data

US 2012/0324816 A1 Dec. 27, 2012

(30) Foreign Application Priority Data

Feb. 8, 2010 (CN) ..... 2010 1 0123676

(51) Int. Cl.
*E04F 13/00* (2006.01)
*E04B 5/02* (2006.01)

(52) U.S. Cl.
CPC ..... *E04B 5/02* (2013.01)

(58) Field of Classification Search
USPC ..... 52/177, 589.1, 309.1, 311.2, 384, 52/403.1, 578, 385, 392, 588.1, 592.1
See application file for complete search history.

(56) References Cited

U.S. PATENT DOCUMENTS

| | | | | |
|---|---|---|---|---|
| 4,807,412 | A * | 2/1989 | Frederiksen | 52/177 |
| 5,323,575 | A * | 6/1994 | Yeh | 52/177 |
| 7,114,298 | B2 * | 10/2006 | Kotler | 52/177 |
| 7,137,229 | B2 | 11/2006 | Pervan | |
| 7,543,417 | B2 | 6/2009 | McIntosh et al. | |
| 7,690,160 | B2 * | 4/2010 | Moller, Jr. | 52/177 |
| 7,779,602 | B2 * | 8/2010 | Collison | 52/747.1 |
| 8,146,319 | B2 * | 4/2012 | McIntosh et al. | 52/589.1 |
| 2003/0177728 | A1 * | 9/2003 | Ku | 52/403.1 |
| 2005/0028475 | A1 * | 2/2005 | Barlow et al. | 52/578 |
| 2009/0038253 | A1 | 2/2009 | Martensson | |
| 2009/0053382 | A1 | 2/2009 | Kawamura et al. | |
| 2012/0073236 | A1 * | 3/2012 | Tang | 52/588.1 |
| 2012/0144770 | A1 | 6/2012 | McIntosh et al. | |
| 2012/0317911 | A1 * | 12/2012 | Huang | 52/309.1 |

FOREIGN PATENT DOCUMENTS

| | | |
|---|---|---|
| CN | 2175275 Y | 8/1994 |
| CN | 2389959 | 8/2000 |
| CN | 2394985 Y | 9/2000 |
| CN | 2491539 | 5/2002 |

(Continued)

OTHER PUBLICATIONS

International Patent Application No. PCT/CN2010/001304 International Search Report dated Dec. 9, 2010.

*Primary Examiner* — Jeanette E Chapman
*Assistant Examiner* — Daniel Kenny

(57) ABSTRACT

Aspects relate to improved floor boards. Certain embodiments may be laid and fixed without the need for fixing with adhesive or nails. In one embodiment, a floor board includes a four-sided surface board connected to a four-sided base board. Further example floor boards include staggered tongue-shaped hooking tongues for connection of multiple floor boards.

12 Claims, 11 Drawing Sheets

(56) References Cited

FOREIGN PATENT DOCUMENTS

| | | |
|---|---|---|
| CN | 2499489 | 7/2002 |
| CN | 2505415 | 8/2002 |
| CN | 2591128 | 12/2003 |
| CN | 2639430 | 9/2004 |
| CN | 2642913 | 9/2004 |
| CN | 29189621 | 7/2007 |
| CN | 101148941 | 3/2008 |
| CN | 201078071 | 6/2008 |
| CN | 101718142 A | 6/2010 |
| CN | 201495736 | 6/2010 |
| CN | 101775891 A | 7/2010 |
| CN | 201581597 U | 9/2010 |
| CN | 101881076 | 11/2010 |
| CN | 201704926 | 1/2011 |
| EP | 0543583 | 5/1993 |
| GB | 857025 | 12/1960 |
| JP | 2001227139 | 8/2001 |
| JP | 2007146603 | 6/2007 |
| UA | 98444 | 5/2012 |
| WO | 2007044293 | 4/2007 |
| WO | 2008088239 | 7/2008 |
| WO | 2011075933 | 6/2011 |

* cited by examiner

INTERLOCKING MODULAR FLOOR TILE

CROSS REFERENCE TO RELATED APPLICATIONS

This is a U.S. National Phase Application under 35 U.S.C. §371 of International Application No. PCT/CN2010/001304, filed Aug. 27, 2010, which was published under PCT Article 21(2) and claims priority to each of Chinese Patent Application Nos. 200910215155.6; 201010123676.1; and 201010203493.0, filed Dec. 23, 2009; Feb. 8, 2010; and Jun. 9, 2010, respectively, and the entire contents of which are incorporated herein by reference in their entireties for any and all non-limiting purposes.

TECHNICAL FIELD

The present invention relates to a floor board.

BACKGROUND ART

Existing floor boards are generally composed of a board body and protruding connectors arranged around the board body; when the floor boards are laid, one of the floor boards is laid over the protruding connectors of another floor board, and the two boards are fixed and connected with adhesive or iron nails; because this type of floor board must be fixed and connected with adhesive or iron nails, it is very inconvenient for use.

SUMMARY OF THE INVENTION

The purpose of the present invention is to provide an easy-to-lay floor board that is convenient for use and simple in structure.

Certain embodiments implemented in this fashion: the floor board comprises a four-sided base board and a four-sided surface board fixed and connected to the four-sided base board; the four-sided base board comprises a four-sided base board body and board-shaped hooking tongues that are arranged on the edges of the four-sided base board body and protrude outward from the edges of the four-sided base board body; each edge of the four-sided base board body is uniformly provided with several board-shaped hooking tongues; the underside of the edge of the four-sided base board body is provided with buckles beside the board-shaped hooking tongues, corresponding to the board-shaped hooking tongues; the positions of the board-shaped hooking tongues on two edges of the four-sided base board body and the positions of the board-shaped hooking tongues on two other edges of the four-sided base board body are arranged in a staggered manner, and the positions of the buckles on two edges of the four-sided base board body and the positions of the buckles on two other edges of the four-sided base board body are arranged in a staggered manner. At the time of use, the edge of one of the floor boards is connected edge-to-edge to the edge of another floor board, and in making such connection, the board-shaped hooking tongues and the buckles of the two edges are arranged in a staggered manner, and in this way, the board-shaped hooking tongues and the buckles on the edge of one of the floor boards can be engaged together with the buckles and the board-shaped hooking tongues of another floor board, and by adopting the form of connection with hooking tongues and buckles, even if the board-shaped hooking tongues and the buckles on one of the edges are disengaged, the board-shaped hooking tongues and the buckles on the other edge are still in an engaged status, so that the reliability of the connection of the two boards is ensured, and the floor boards laid on the floor can be connected firmly without the need for adhesive or iron nails.

Here, the four-sided base board comprises a four-sided base board skeleton frame and a functional board fixed within the four-sided base board skeleton frame; the four-sided base board skeleton frame comprises two end-to-end connected L-shaped skeleton units and the hooking tongues and buckles provided on the external edges of the L-shaped skeleton units; the horizontal skeleton end of the L-shaped skeleton unit is provided with insertion blocks while the inner side of the vertical skeleton end corresponding to the insertion blocks is provided with recesses for insertion, or the inner side of the vertical skeleton end is provided with insertion blocks while the horizontal skeleton end of the L-shaped skeleton unit corresponding to the insertion blocks is provided with recesses for insertion, wherein the insertion blocks and recesses for insertion of one of the L-shaped skeleton units are connected in a matching fashion with the recesses for insertion and insertion blocks of the other L-shaped skeleton unit by way of insertion. Because the base board is composed of the four-sided base board skeleton frame, which is itself composed of two L-shaped skeleton units and the functional board fixed inside the four-sided base board skeleton frame, the members that constitute the base board are small in area, easily fabricated, and do not need equipments that require large investment; and after the area is reduced, the members cannot be easily distorted, so that the stability of quality is effectively ensured. With regard to the adoption of functional boards, corresponding functional boards may be adopted according to needs in actual use, thereby enriching the varieties and functions of the products.

Here, in order for the floor boards to be tightly and firmly connected at the time of connection, the distance from the inner side of the tongue head of the board-shaped hooking tongue to the edge of the four-sided base board body is equal to the distance from the inner side of the head of the buckle to the edge of the four-sided base board body.

To facilitate dismantling or installation, the root sections on both sides of the board-shaped hooking tongue are provided with a notch perpendicular to the edge of the four-sided base board body, while the positions on both sides of the buckle located on the edge of the four-sided base board body are provided with a notch perpendicular to the edge of the four-sided base board body. In this way, at the time of dismantling or installation, the notch may be used to bend the board-shaped hooking tongue and the buckle to a certain angle along the edge of the four-sided base board body, so as to make it convenient to hook the board-shaped hooking tongue to the buckle or disengage same from the buckle by means of bending the board-shaped hooking tongue and the buckle to a certain angle along the edge of the four-sided base board body at the time of dismantling or installation.

In order to enrich the decorative patterns of the board surface after the boards are laid, a decorative strip is provided; said decorative strip comprises the decorative strip body, a board-shaped hooking tongue that is provided on one side or two sides of the decorative strip body, protruding outward from the side edge of the decorative strip body and corresponding to the buckle as provided on the underside of the edge of the four-sided base board body, as well as a buckle that is provided on the underside of the edge of one or two sides of the decorative strip body and corresponds to the hooking tongue as provided on the edge of the four-sided base board body. At the time of use, one floor board is connected to another floor board through the decorative strip, and in making the end-to-end connection, the decorative strip and the board-shaped hooking tongues and buckles on both sides of the floor board are arranged in a staggered manner; in this way, the board-shaped hooking tongues and buckles on the edge of the floor board can be engaged with the buckles and board-shaped hooking tongues of the decorative strip, and by adopting the form of connection with hooking tongues and buckles, even if the board-shaped hooking tongues and the buckles on one of the edges are disengaged, the board-shaped hooking tongues and the buckles on the other edge are still in an engaged status, so that the reliability of the connection of the decorative strip and the floor board is ensured, and the floor boards laid on the floor can be connected firmly without the need for adhesive or iron nails. By adopting decorative strips, the laid floor surface with good decorative effects may be formed through matching the decorative strips of different colors with the floor boards, and in addition, the use of decorative strips can visually diminish the gaps where floor boards and decorative strips are connected, so that visual effects are greatly improved. Furthermore, the use of a decorative strip with hooking tongues and buckles provided on one side can effectively decorate the margins of the laid floor boards to make the visual effects of the laid floor boards even better and further improved. Here, in order for the floor boards and decorative strips to be tightly and firmly connected at the time of connection, the distance from the inner side of the tongue head of the board-shaped hooking tongue to the edge of the four-sided base board body is equal to the distance from the inner side of the head of the buckle to the edge of the four-sided base board body.

To facilitate dismantling or installation, the root sections on both sides of the board-shaped hooking tongue on the floor board are provided with a notch perpendicular to the edge of the four-sided base board body, while the positions on both sides of the buckle located on the edge of the four-sided base board body on the floor board are provided with a notch perpendicular to the edge of the four-sided base board body. In this way, at the time of dismantling or installation, the notch may be used to bend the board-shaped hooking tongue and the buckle to a certain angle along the edge of the four-sided base board body, so as to make it convenient to hook the board-shaped hooking tongue to the buckle or disengage same from the buckle by means of bending the board-shaped hooking tongue and the buckle to a certain angle along the edge of the four-sided base board body at the time of dismantling or installation.

Here, the two sides of the decorative strip are provided with board-shaped hooking tongues that protrude outward from the side edge of the decorative strip body and correspond to the buckles as provided on the underside of the edge of the four-sided base board body, as well as buckles that are provided on the underside of the two sides of the decorative strip body and correspond to the hooking tongues as provided on the edge of the four-sided base board body, and the two ends of the decorative strip body are set at an angle of 90°. In this way, the decorative strips for connection between the floor boards can be connected end-to-end to form perfect connection effects. The thickness of the decorative strip body is consistent with the thickness of the four-sided base board and the four-sided surface board put together, and in this way, after the decorative strips and the floor boards are assembled, the surface of the laid floor boards is level and smooth.

Here, the same side of the decorative strip is provided with board-shaped hooking tongues that protrude outward from the side edge of the decorative strip body and correspond to the buckles as provided on the underside of the edge of the four-sided base board body, as well as buckles that correspond to the hooking tongues as provided on the edge of the four-sided base board body. In this way, the decorative strip can be used for decorating the margins of the laid floor boards.

Here, the same side of the decorative strip is provided with board-shaped hooking tongues that protrude outward from the side edge of the decorative strip body and correspond to the buckles as provided on the underside of the edge of the four-sided base board body as well as buckles that correspond to the hooking tongues as provided on the edge of the four-sided base board body; the board-shaped hooking tongues are perpendicular to the front surface of the decorative strip, and the buckles are located under the back surface of the vertically placed decorative strip. In this way, this type of decorative strip can be used at a position where the floor board meets a wall, and provide a natural and visually pleasing transition between the floor board and the wall. The side of the lower edge of the vertically placed decorative strip is provided with an insertion groove that matches the four-sided surface board, and at the time of use, based on the shape of the floor for laying floor boards, the four-sided base board and the four-sided surface board of the floor board close to the wall are cut to match the size of the floor, and the cut four-sided surface board should extend slightly beyond the four-sided base board, so that it can be inserted into the insertion groove as provided on the side of the lower edge of the decorative strip fixed to the corner of the wall.

In comparison with the state of the art, due to the adoption of board-shaped hooking tongues and buckles that are provided on different edges in a staggered way, the present invention thus features the advantages of being able to have floor boards laid and fixed very conveniently without the need for fixing with adhesive or iron nails, and of being convenient for use and simple in structure, and after the decorative strip is adopted, it further has the advantage of good decorative effects.

DESCRIPTION OF ATTACHED DRAWINGS

SPECIFIC EMBODIMENTS

Figure 1:
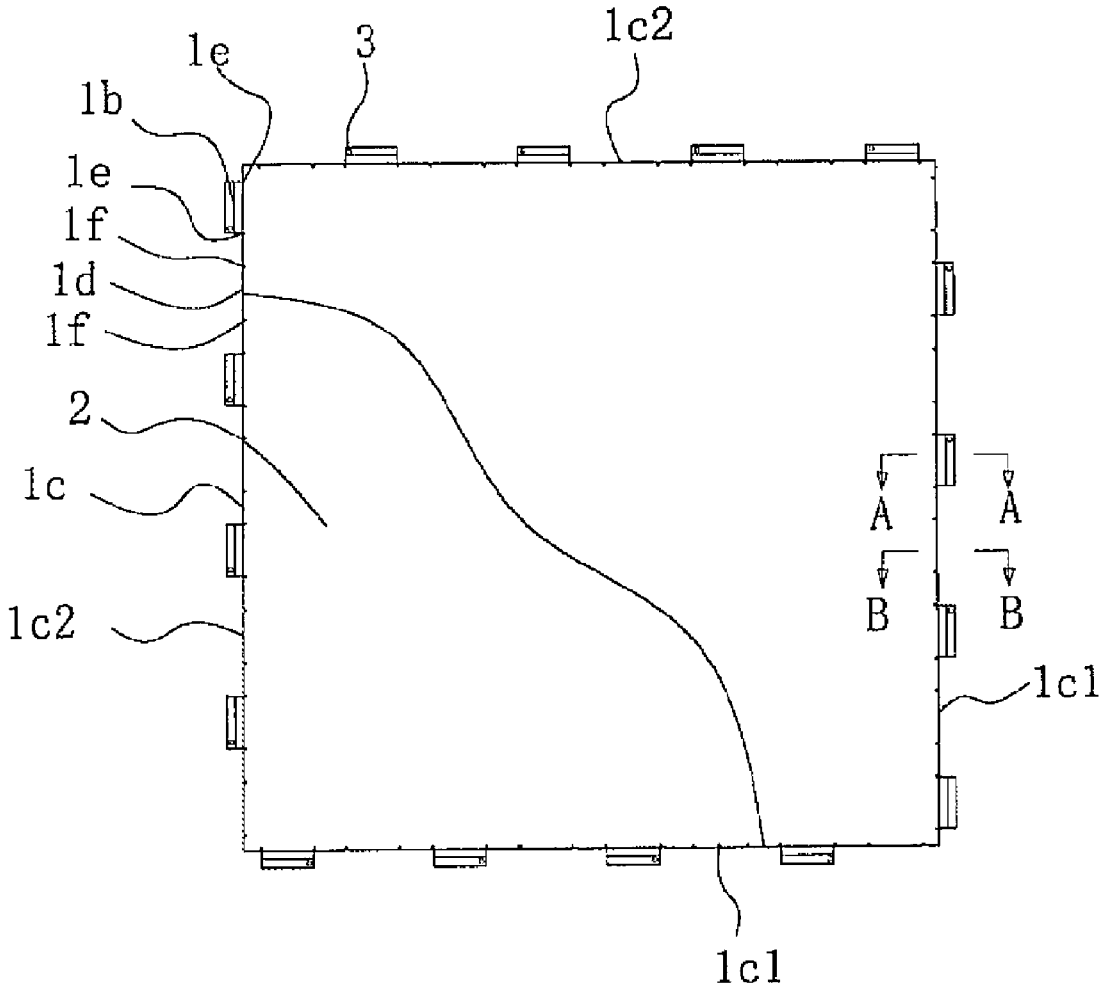
FIG. 1 is a structural representation of the four-sided base board and the four-sided surface board in Embodiment 1 of the present invention.
Figure 2:
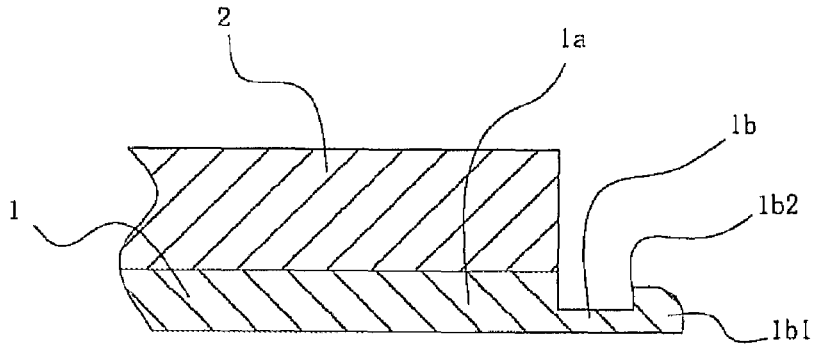
FIG. 2 is an A-A sectional view of FIG. 1.
Figure 3:
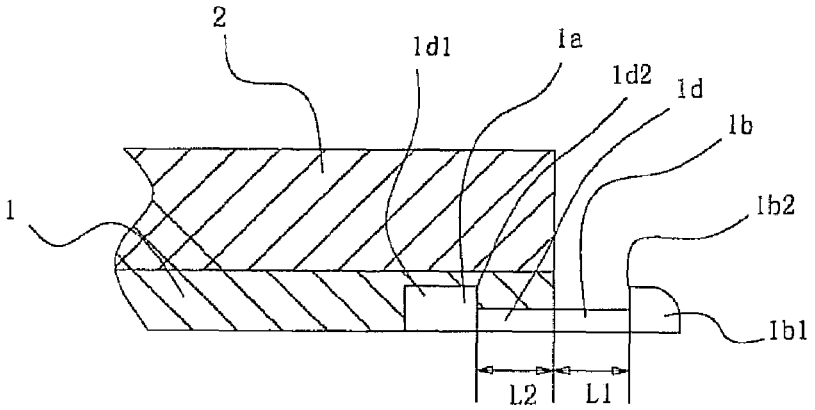
FIG. 3 is a B-B sectional view of FIG. 1.
Figure 4:
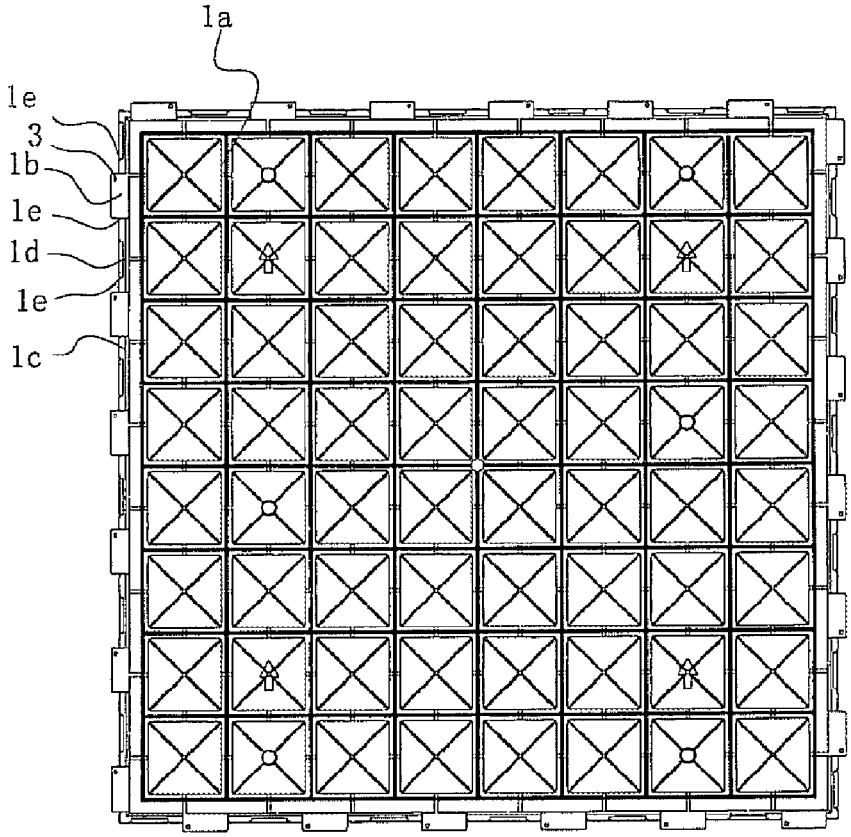
FIG. 4 is a rear view of FIG. 1.
Figure 5:
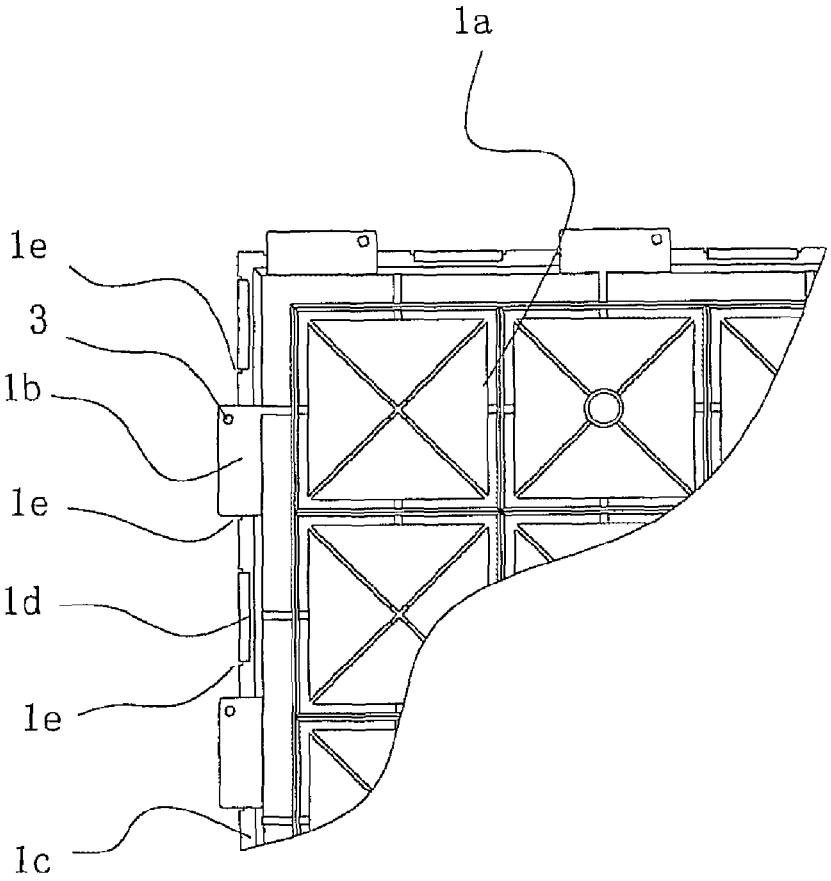
FIG. 5 is a partial enlarged view of FIG. 4.
Figure 6:
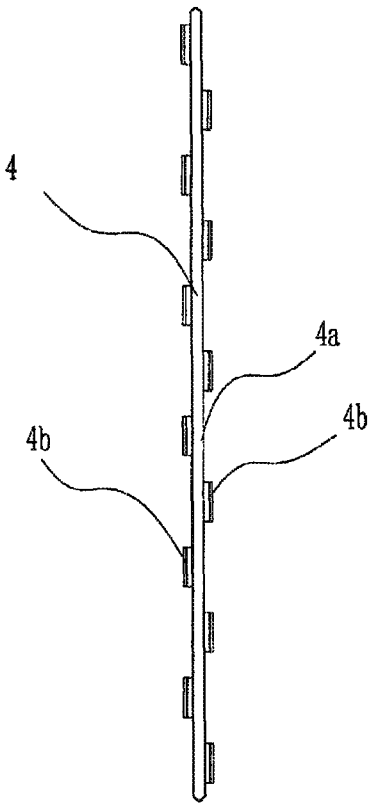
FIG. 6 is a structural representation of Decorative Strip Embodiment 1.
Figure 7:
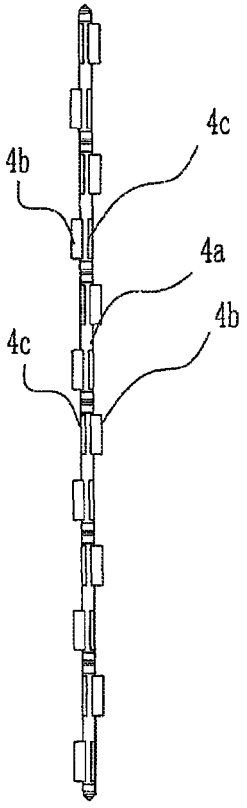
FIG. 7 is a rear view of FIG. 6.

The present invention is now further described in detail, in combination with the attached drawings and embodiments:

Embodiment 1: As shown in FIGS. 1, 2, 3, 4, 5, 6 and 7, the floor board of the present invention comprises the square base board 1, the square surface board 2 fixed and connected to the square base board 1, and the decorative strip 4; the square base board 1 comprises the square base board body 1*a* and the board-shaped hooking tongue 1*b* that is provided on the edge of the square base board body 1*a*; each edge of the square base board body 1*a* is uniformly provided with several board-shaped hooking tongues 1*b*; the underside of the edge 1*c* of the square base board body 1*a* is provided with a buckle 1*d* beside the board-shaped hooking tongue 1*b*, corresponding to the board-shaped hooking tongue 1*b*; the positions of the board-shaped hooking tongues 1*b* on two edges 1*c*1 of the square base board body 1*a* and the positions of the board-shaped hooking tongues 1*b* on two other edges 1*c*2 of the square base board body 1*a* are arranged in a staggered manner, and the positions of the buckles 1*d* on two edges 1*c*1 of the square base board body 1*a* and the positions of the buckles 1*d* on two other edges 1*c*2 of the square base board body 1*a* are arranged in a staggered manner. The distance L1 from the inner side 1*b*2 of the tongue head 1*b*1 of the board-shaped hooking tongue 1*b* to the edge 1*c* of the square base board body 1*a* is equal to the distance L2 from the inner side 1*d*2 of the head 1*d*1 of the buckle 1*d* to the edge of the square base board body 1*a*. The root sections on both sides of the board-shaped hooking tongue 1*b* are provided with a notch le perpendicular to the edge 1*c* of the square base board body 1*a*, while the positions on both sides of the buckle 1*d* located on the edge of the square base board body 1*a* are provided with a notch if perpendicular to the edge of the square base board body 1*a*.

Where the floor is not level, in order to make all the laid floor boards stay level and smooth, the board-shaped hooking tongue 1*b* is provided with a through-hole 3. In this way, when the uneven floor makes a laid floor board warp upwards, a nail may be used to position embodiments and/or prevent the embodiment from warping upwards, or embodiments may be tightly attached to the floor board with adhesive flowing through the through-hole 3.

The decorative strip 4 comprises the decorative strip body 4*a*, the board-shaped hooking tongue 4*b* that is provided on the two sides of the decorative strip body 4*a*, protruding outward from the side edge of the decorative strip body 4*a* and corresponding to the buckle 1*d* as provided on the underside of the edge of the four-sided base board body 1*a*, as well as the buckle 4*c* that is provided on the underside of the edge of the two sides of the decorative strip body 4*a* and corresponds to the hooking tongue 1*b* as provided on the edge of the four-sided base board body 1*a*. The two ends of the decorative strip body 4*a* are set at an angle of 90°. The thickness of the decorative strip body 4*a* is consistent with the thickness of the square base board 1 and the square surface board 2 put together.

At the time of use, the square base boards 1 with the square surface boards 2 may be connected to form grid patterns of floor boards by means of the decorative strips 4.

Figure 8:
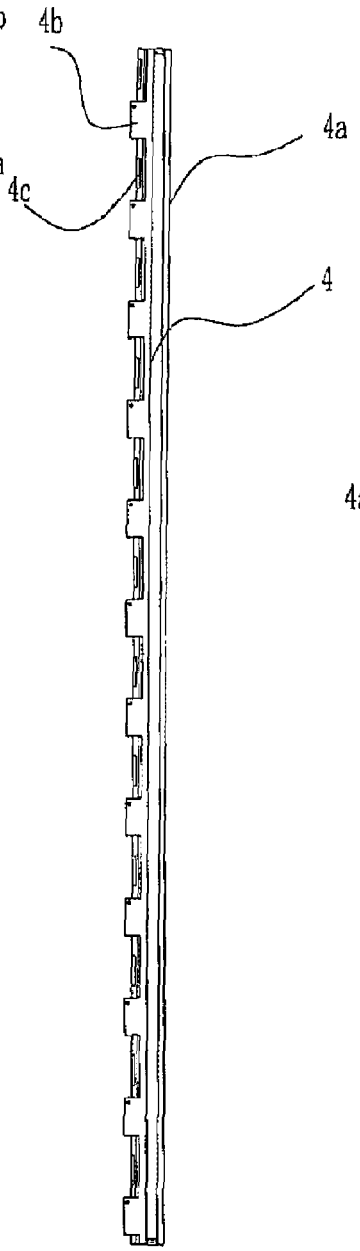
FIG. 8 is a structural representation of Decorative Strip Embodiment 2.
Figure 9:
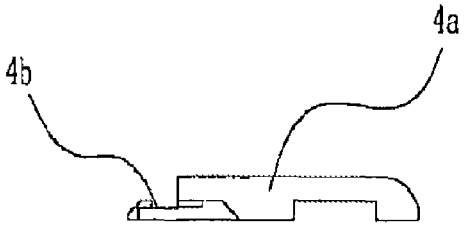
FIG. 9 is an upward view of FIG. 8.

Decorative Strip Embodiment 2:

As shown in FIGS. 8 and 9, the same side of the decorative strip 4 is provided with board-shaped hooking tongues 4*b* that protrude outward from the side edge of the decorative strip body 4*a* and correspond to the buckles id as provided on the underside of the edge of the square base board body 1*a*, as well as the buckles 4*c* that correspond to the hooking tongues 1*b* as provided on the edge of the square base board body 1*a*. The thickness of the decorative strip body 4*a* is consistent with the thickness of the square base board 1 and the square surface board 2 put together. The decorative strip in Embodiment 2 may be applied to the decoration of the margins of the laid floor boards by way of connection with the hooking tongues 1*b* and the buckles 1*d* on the margins of the laid floor boards.

Figure 10:
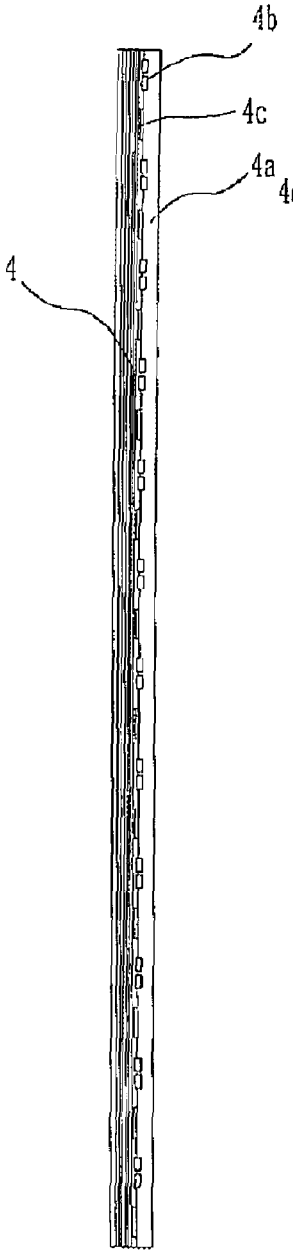
FIG. 10 is a structural representation of Decorative Strip Embodiment 3.
Figure 11:
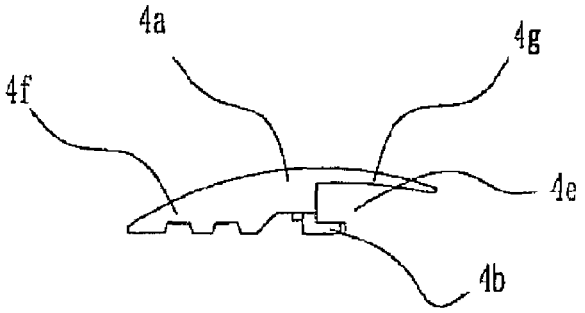
FIG. 11 is an upward view of FIG. 10.

Decorative Strip Embodiment 3:

As shown in FIGS. 10 and 11, on the basis of Decorative Strip Embodiment 2, with regard to this embodiment, the upper surface of the decorative strip body 4*a* is a cambered surface, and an insertion slot 4*e* is formed between one side 4*g* of the cambered surface and the board-shaped hooking tongue 4*b*. In this way, at the time of use, one side 4*g* of the cambered surface tightly adjoins the square surface board 2, while the other side 4*f* of the cambered surface forms a natural transition with the floor, creating a point of access.

Figure 12:
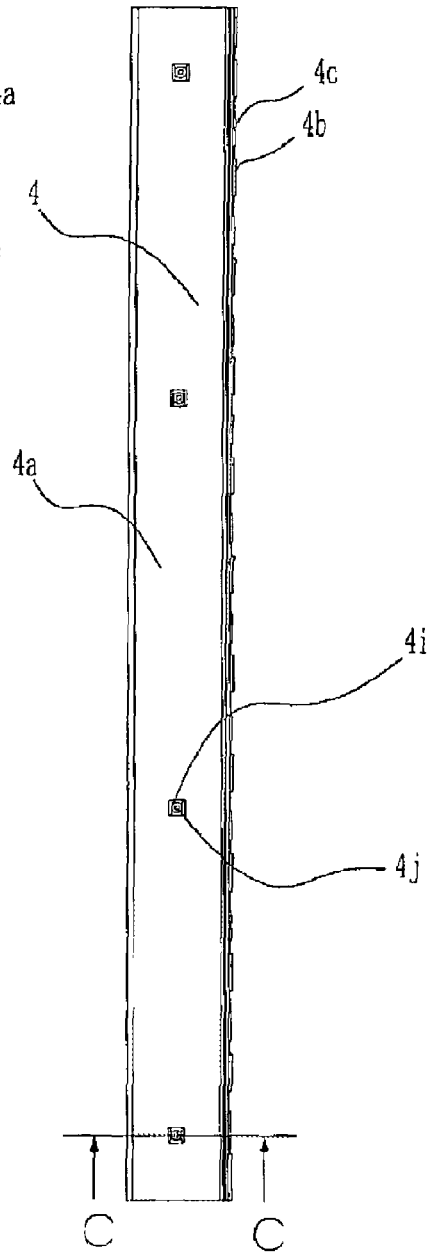
FIG. 12 is a structural representation of Decorative Strip Embodiment 4.
Figure 13:
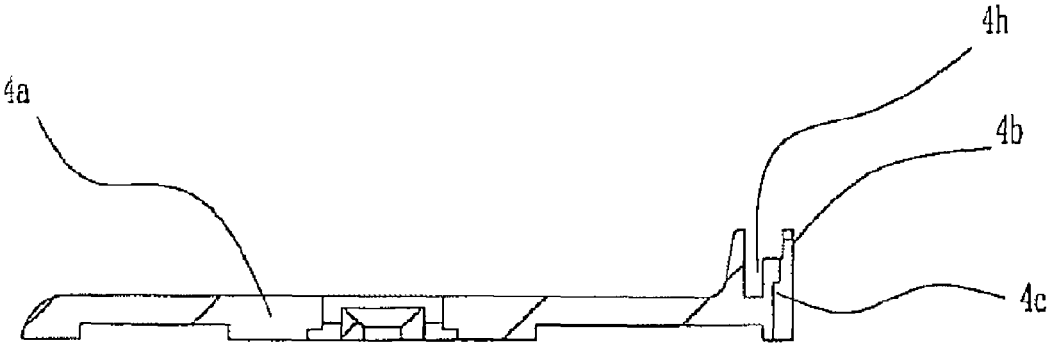
FIG. 13 is a C-C sectional view of FIG. 12.
Figure 15:
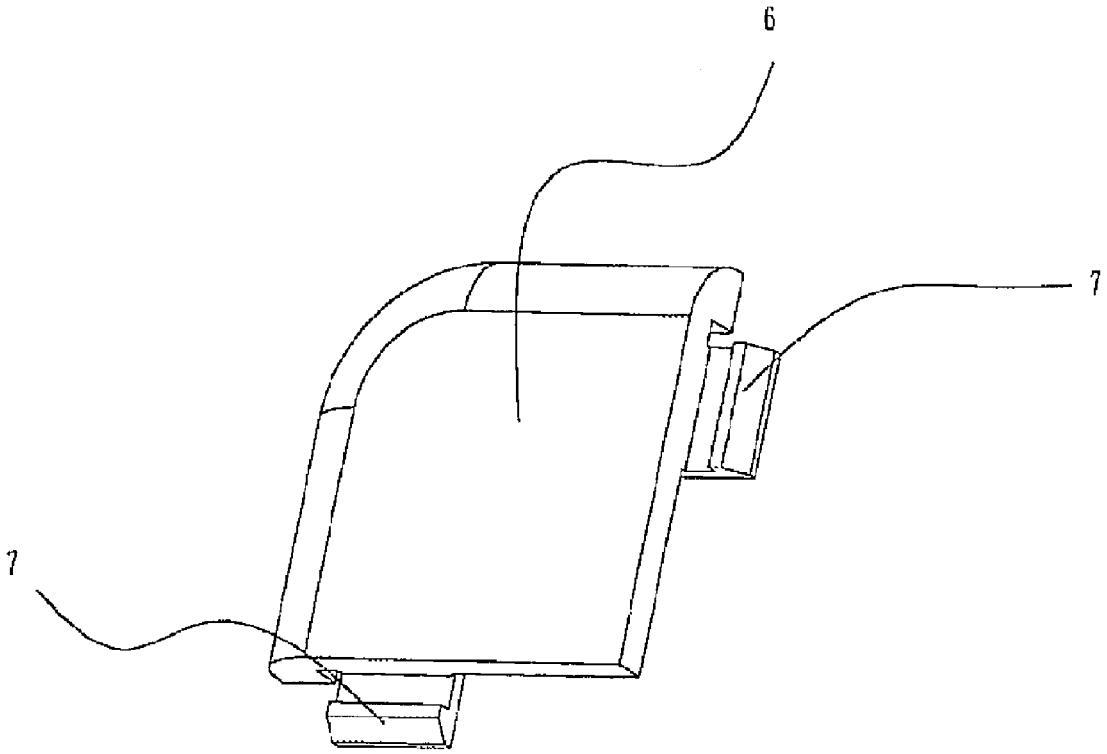
FIG. 15 is a structural representation of the corner decoration block.
Figure 14:
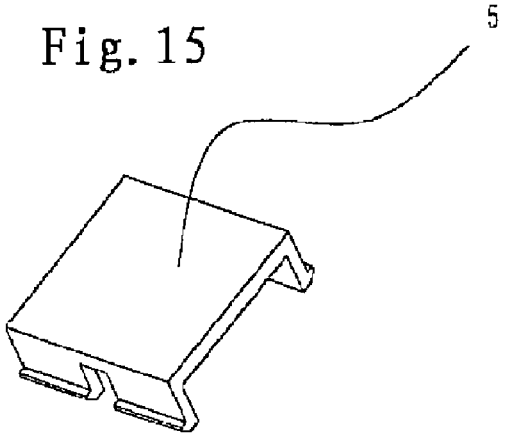
FIG. 14 is a structural representation of the decoration block in FIG. 12.

Decorative Strip Embodiment 4:

As shown in FIGS. 12 and 13, on the basis of Decorative Strip Embodiment 2, with regard to this embodiment, the board-shaped hooking tongue 4*b* is perpendicular to the front surface of the decorative strip body 4*a*, and the buckle 4*c* is located under the back surface of the vertically placed decorative strip body 4*a*. In this way, this type of decorative strip can be used at a position where the floor board meets a wall, and provide a natural and visually pleasing transition between the floor board and the wall. The side of the lower edge of the vertically placed decorative strip body 4*a* is provided with an insertion groove 4*h* that matches the square surface board 2, and at the time of use, based on the shape of the floor for laying floor boards, the four-sided base board and the four-sided surface board of the floor board close to the wall are cut to match the size of the floor, and the cut square surface board 2 should extend slightly beyond the square base board 1 so that it can be inserted into the insertion groove 4*h* as provided on the side of the lower edge of the decorative strip body 4*a* fixed to the corner of the wall. A recess 4*i* is provided on the vertically placed decorative strip body 4*a;* a through-hole 4*j* is provided inside the recess 4*i*, and a decoration block 5 is provided on the recess 4*i* (as shown in FIG. 14). At the time of use, the nail that goes through the through-hole 4*j* fixes the vertically placed decorative strip body 4*a* to the corner of the wall, and the recess 4*i* is then decorated with the decoration block 5. In order to decorate the corner of the laid floor board, a corner decoration block 6 is further provided (as shown in FIG. 15), and the protruding hooking tongue 7 is provided on the corner decoration block 6.

Figure 16:
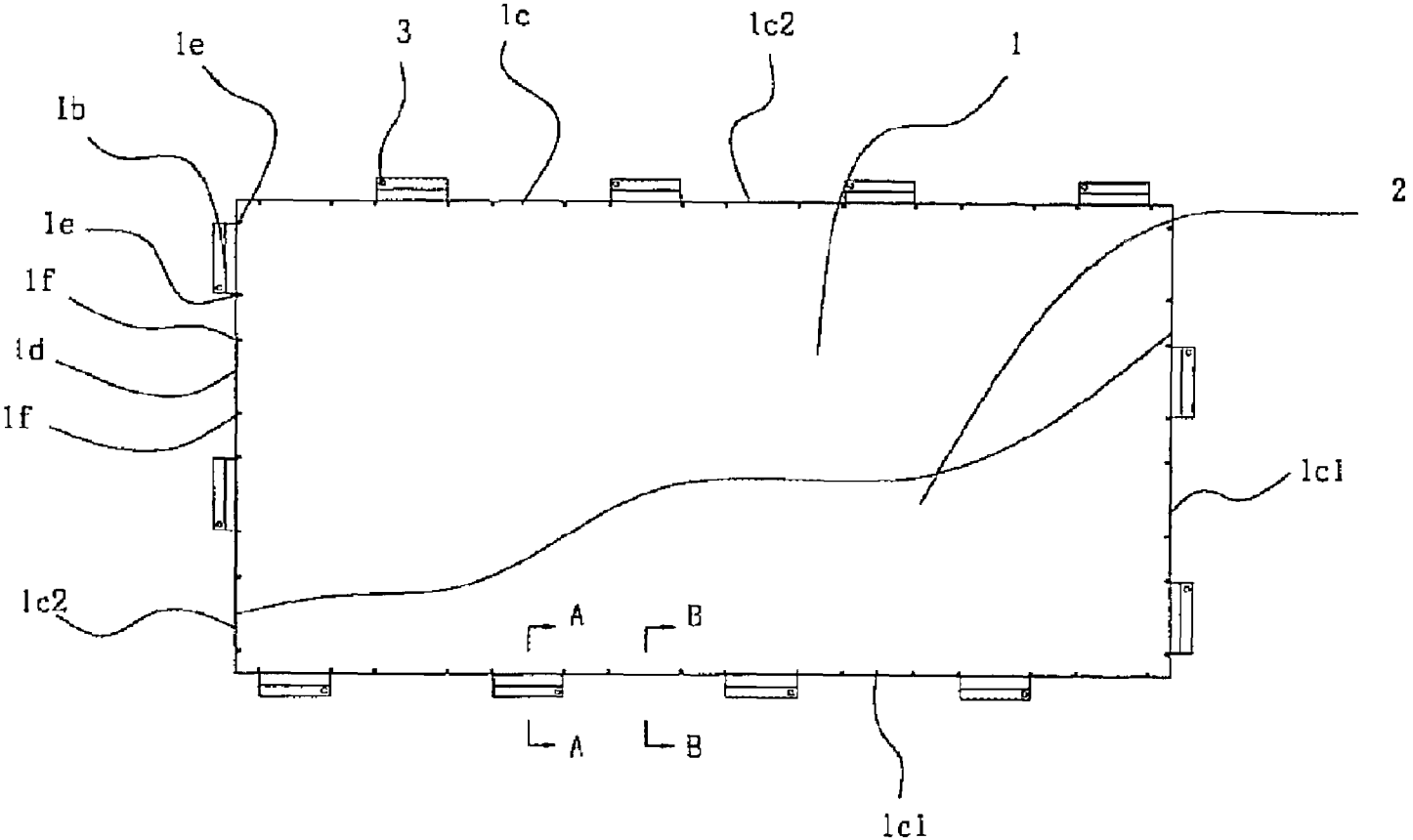
FIG. 16 is a structural representation of the four-sided base board and the four-sided surface board in Embodiment 2 of the present invention.

Embodiment 2 for four-sided base board and four-sided surface board: As shown in FIG. 16, the present embodiment is based on Embodiment 1; the four-sided base board 1 is a rectangle, and the corresponding four-sided surface board 2 is a rectangle.

Figure 17:
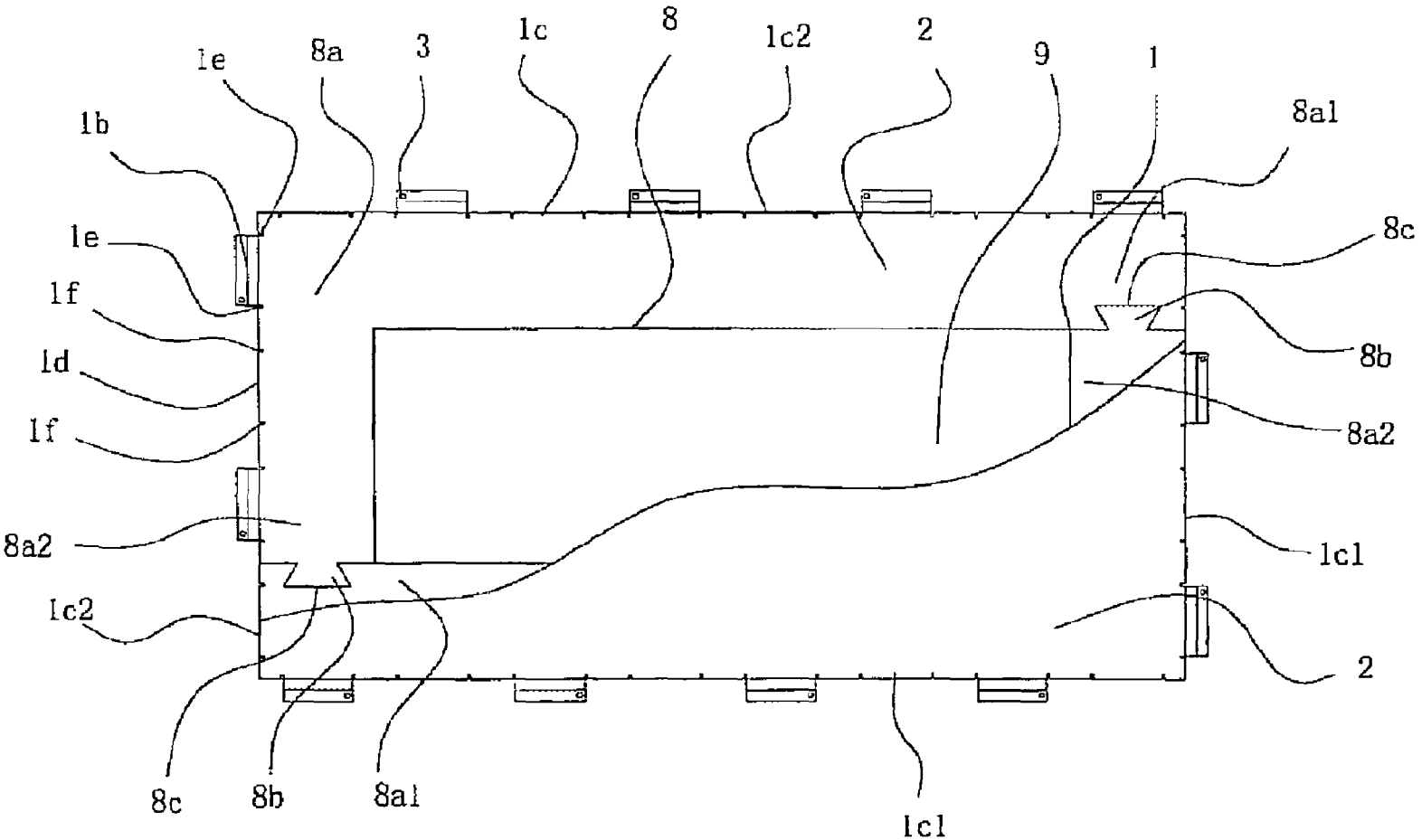
FIG. 17 is a structural representation of the four-sided base board in Embodiment 3 of the present invention.

Embodiment 3 for the four-sided base board: As shown in FIG. 17, the four-sided base board 1 comprises a four-sided base board skeleton frame 8 and a functional board 9 fixed within the four-sided base board skeleton frame 8; the four-sided base board skeleton frame 8 comprises two end-to-end connected L-shaped skeleton units 8*a*, the hooking tongue 1*b* and the buckle 1*d* provided on the external edge of the L-shaped skeleton unit 8*a*; the horizontal skeleton end 8*a*1 of the L-shaped skeleton unit 8*a* is provided with the insertion block 8*b*, while the inner side of the vertical skeleton end 8*a*2 corresponding to the insertion block 8*b* is provided with a recess for insertion 8*c*, and the insertion block 8*b* and the recess for insertion 8*c* of one of the L-shaped skeleton units 8*a* are connected end-to-end with the recess for insertion 8*c* and the insertion block 8*b* of the other L-shape skeleton unit 8*a* by way of insertion.

Figure 18:
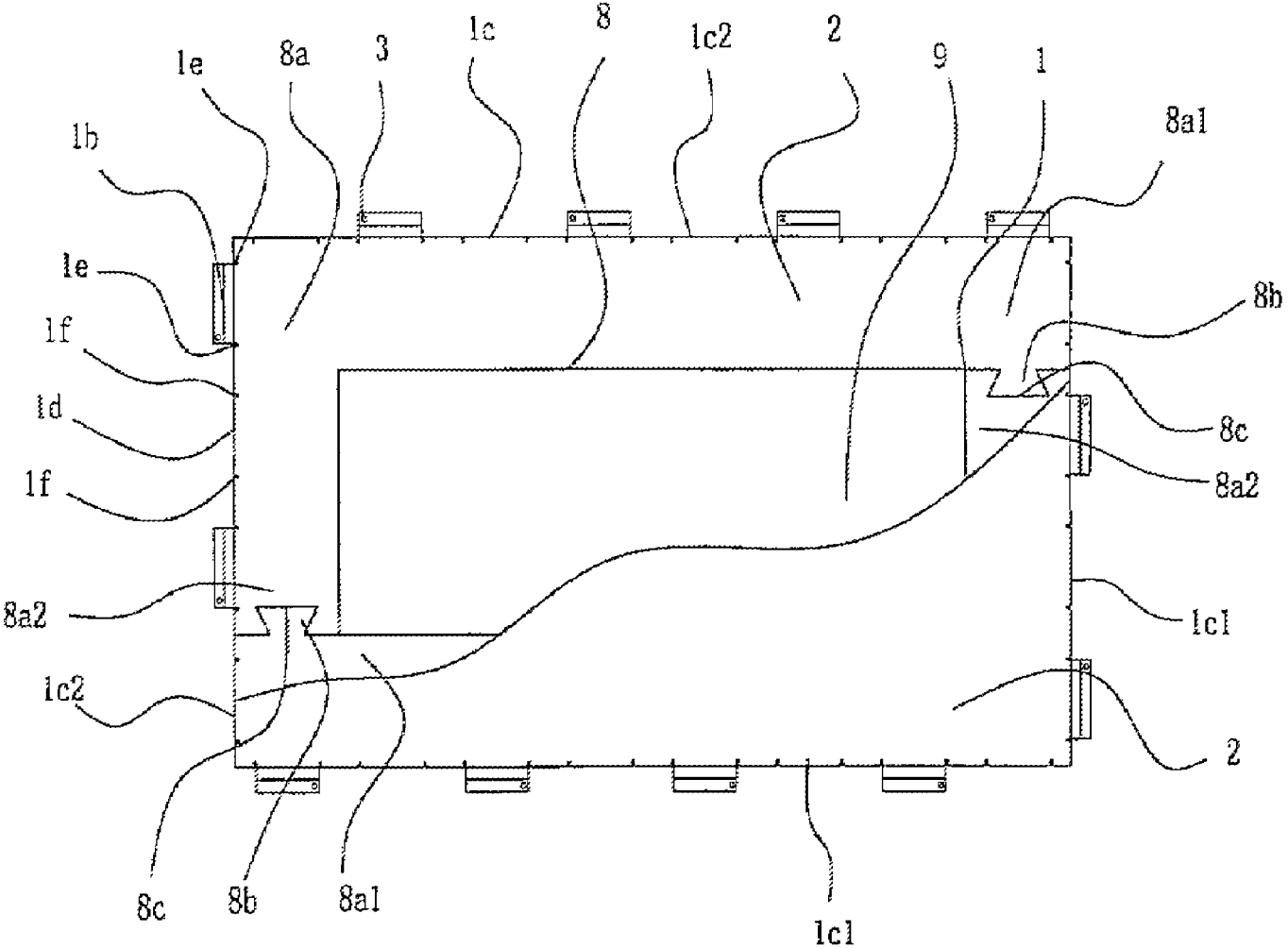
FIG. 18 is a structural representation of the four-sided base board in Embodiment 4 of the present invention.

Embodiment 4 for the four-sided base board: As shown in FIG. 18, the present embodiment is based on Embodiment 3 for the four-sided base board; the inner side of the vertical skeleton end 8*a*2 is provided with an insertion block 8*b* while the horizontal skeleton end 8*a*1 of the L-shaped skeleton unit 8*a* is provided with a recess for insertion 8*c*, and the insertion block 8*b* and the recess for insertion 8*c* of one of the L-shaped skeleton units 8*a* are connected end-to-end with the recess for insertion 8*c* and the insertion block 8*b* of the other L-shape skeleton unit 8*a* by way of insertion.

The invention claimed is:

1. An easy-to-lay floor board, comprising:

a four-sided surface board fixed and connected to a four-sided base board, the four-sided base board further comprising:

a four-sided base board body;

tongue-shaped hooking tongues that are provided on the edges of the four-sided base board body, wherein each edge of the four-sided base board body is uniformly provided with several tongue-shaped hooking tongues, wherein the underside of the edge of the four-sided base board body is provided with buckles beside the tongue-shaped hooking tongues, corresponding to the tongue-shaped hooking tongues, wherein the positions of the tongue-shaped hooking tongues on two edges of the four-sided base board body and the positions of the tongue-shaped hooking tongues on two other edges of the four-sided base board body are arranged in a staggered manner, wherein the positions of the buckles on two edges of the four-sided base board body and the positions of the buckles on two other edges of the four-sided base board body are arranged in a staggered manner;

a four-sided base board skeleton frame;

a functional board fixed within the four-sided base board skeleton frame, wherein the four-sided base board skeleton frame comprises two end-to-end connected L-shaped skeleton units;

hooking tongues and buckles provided on the external edges of the L-shaped skeleton units;

a horizontal skeleton end of the L-shaped skeleton unit having insertion blocks; and an inner side of a vertical skeleton end corresponding to the insertion blocks is provided with recesses for insertion, or the inner side of the vertical skeleton end is provided with insertion blocks while horizontal skeleton end of the L-shaped skeleton unit is provided with recesses for insertion, wherein the insertion blocks and recesses for insertion of one of the L-shaped skeleton units are connected end-to-end with the recesses for insertion and insertion blocks of the other L-shaped skeleton unit by way of insertion.

2. An easy-to-lay floor board, comprising:

a four-sided surface board fixed and connected to a four-sided base board, the four-sided base board further comprising:

a four-sided base board body;

tongue-shaped hooking tongues that are provided on edges of the four-sided base board body, wherein each edge of the four-sided base board body is uniformly provided with several tongue-shaped hooking tongues, wherein an underside of an edge of the four-sided base board body is provided with buckles beside the tongue-shaped hooking tongues, corresponding to the tongue-shaped hooking tongues, wherein the positions of the tongue-shaped hooking tongues on two edges of the four-sided base board body and the positions of the tongue-shaped hooking tongues on two other edges of the four-sided base board body are arranged in a staggered manner, wherein the positions of the buckles on two edges of the four-sided base board body and the positions of the buckles on two other edges of the four-sided base board body are arranged in a staggered manner;

a four-sided base board skeleton frame;

a functional board fixed within the four-sided base board skeleton frame, wherein the four-sided base board skeleton frame comprises two end-to-end connected L-shaped skeleton units;

hooking tongues and buckles provided on the external edges of the L-shaped skeleton units;

a horizontal skeleton end of the L-shaped skeleton unit having insertion blocks; and an inner side of a vertical skeleton end corresponding to the insertion blocks is provided with recesses for insertion, or the inner side of the vertical skeleton end is provided with insertion blocks while the horizontal skeleton end of the L-shaped skeleton unit is provided with recesses for insertion, wherein the insertion blocks and recesses for insertion of one of the L-shaped skeleton units are connected end-to-end with the recesses for insertion and insertion blocks of the other L-shape skeleton unit by way of insertion, wherein a distance from the inner side of the tongue head of the tongue-shaped hooking tongue to the edge of the four-sided base board body is equal to the distance from the inner side of the head of the buckle to the edge of the four-sided base board body, wherein root sections on both sides of the tongue-shaped hooking tongue of the four-side base board are provided with a notch perpendicular to the edge of the four-sided base board body, while the positions on both sides of the buckle located on the edge of the four-sided base board body are provided with a notch perpendicular to the edge of the four-sided base board body, wherein a decorative strip is provided, and the decorative strip comprises the decorative strip body, a tongue-shaped hooking tongue that is provided on one side or two sides of the decorative strip body, protruding outward from the side edge of the decorative strip body and corresponding to the buckle as provided on the underside of the edge of the four-sided base board body, as well as a buckle that is provided on the underside of the edge of one or two sides of the decorative strip body and corresponds to the hooking tongue as provided on the edge of the four-sided base board body, and wherein the two sides of the decorative strip are provided with tongue-shaped hooking tongues that protrude outward from the side edge of the decorative strip body and correspond to the buckles as provided on the underside of the edge of the four-sided base board body, as well as buckles that are provided on the underside of the two sides of the decorative strip body and correspond to the hooking tongues as provided on the edge of the four-sided base board body, and the two ends of the decorative strip body are set at an angle of 90°.

3. The easy-to-lay floor board as claimed in claim 2, characterized in that the tongue-shaped hooking tongue is provided with a through-hole.

4. The easy-to-lay floor board as claimed in claim 2, characterized in that a decorative strip is provided, and the decorative strip comprises a decorative strip body, a tongue-shaped hooking tongue that is provided on one side or two sides of the decorative strip body, protruding outward from the side edge of the decorative strip body and corresponding to the buckle as provided on the underside of the edge of the four-sided base board body, as well as a buckle that is provided on the underside of the edge of one or two sides of the decorative strip body and corresponds to the hooking tongue as provided on the edge of the four-sided base board body.

5. The easy-to-lay floor board as claimed in Claim 2, characterized in that a decorative strip is provided, and the decorative strip comprises the decorative strip body, a tongue-shaped hooking tongue that is provided on one side or two sides of the decorative strip body, protruding outward from the side edge of the decorative strip body and corresponding to the buckle as provided on the underside of the edge of the four-sided base board body, as well as a buckle that is provided on the underside of the edge of one or two sides of the decorative strip body and corresponds to the hooking tongue as provided on the edge of the four-sided base board body.

6. The easy-to-lay floor board as claimed in claim 5, characterized in that the two sides of the decorative strip are provided with tongue-shaped hooking tongues that protrude outward from the side edge of the decorative strip body and correspond to the buckles as provided on the underside of the edge of the four-sided base board body, as well as buckles that are provided on the underside of the two sides of the decorative strip body and correspond to the hooking tongues as provided on the edge of the four-sided base board body, and the two ends of the decorative strip body are set at an angle of 90°.

7. The easy-to-lay floor board as claimed in claim 5, characterized in that the same side of the decorative strip is provided with tongue-shaped hooking tongues that protrude outward from the side edge of the decorative strip body and correspond to the buckles as provided on the underside of the edge of the four-sided base board body, as well as buckles that correspond to the hooking tongues as provided on the edge of the four-sided base board body.

8. An easy-to-lay floor board, comprising:

a four-sided surface board fixed and connected to a four-sided base board, the four-sided base board further comprising:

a four-sided base board body;

tongue-shaped hooking tongues that are provided on edges of the four-sided base board body, wherein each edge of the four-sided base board body is uniformly provided with several tongue-shaped hooking tongues, wherein an underside of an edge of the four-sided base board body is provided with buckles beside the tongue-shaped hooking tongues, corresponding to the tongue-shaped hooking tongues, wherein the positions of the tongue-shaped hooking tongues on two edges of the four-sided base board body and the positions of the tongue-shaped hooking tongues on two other edges of the four-sided base board body are arranged in a staggered manner, wherein the positions of the buckles on two edges of the four-sided base board body and the positions of the buckles on two other edges of the four-sided base board body are arranged in a staggered manner;

a four-sided base board skeleton frame;

a functional board fixed within the four-sided base board skeleton frame, wherein the four-sided base board skeleton frame comprises two end-to-end connected L-shaped skeleton units;

hooking tongues and buckles provided on the external edges of the L-shaped skeleton units;

a horizontal skeleton end of the L-shaped skeleton unit having insertion blocks; and an inner side of a vertical skeleton end corresponding to the insertion blocks is provided with recesses for insertion, or the inner side of the vertical skeleton end is provided with insertion blocks while the horizontal skeleton end of the L-shaped skeleton unit is provided with recesses for insertion, wherein the insertion blocks and recesses for insertion of one of the L-shaped skeleton units are connected end-to-end with the recesses for insertion and insertion blocks of the other L-shape skeleton unit by way of insertion, wherein a distance from the inner side of the tongue head of the tongue-shaped hooking tongue to the edge of the four-sided base board body is equal to the distance from the inner side of the head of the buckle to the edge of the four-sided base board body, wherein root sections on both sides of the tongue-shaped hooking tongue of the four-side base board are provided with a notch perpendicular to the edge of the four-sided base board body, while the positions on both sides of the buckle located on the edge of the four-sided base board body are provided with a notch perpendicular to the edge of the four-sided base board body, wherein a decorative strip is provided, and the decorative strip comprises the decorative strip body, a tongue-shaped hooking tongue that is provided on one side or two sides of the decorative strip body, protruding outward from the side edge of the decorative strip body and corresponding to the buckle as provided on the underside of the edge of the four-sided base board body, as well as a buckle that is provided on the underside of the edge of one or two sides of the decorative strip body and corresponds to the hooking tongue as provided on the edge of the four-sided base board body, wherein the same side of the decorative strip is provided with tongue-shaped hooking tongues that protrude outward from the side edge of the decorative strip body and correspond to the buckles as provided on the underside of the edge of the four-sided base board body, as well as buckles that correspond to the hooking tongues as provided on the edge of the four-sided base board body, and wherein the tongue-shaped hooking tongues are perpendicular to the front surface of the decorative strip, and the buckles are located under a back surface of a vertically placed decorative strip.

9. The easy-to-lay floor board as claimed in claim 8, characterized in that the side of the lower edge of the vertically placed decorative strip body is provided with an insertion groove that matches the square surface board.

10. The easy-to-lay floor board as claimed in claim 9, characterized in that the recess is provided on the vertically placed decorative strip body, a through-hole is provided inside the recess, and a decoration block is provided on the recess.

11. The easy-to-lay floor board as claimed in claim 8, characterized in that a recess is provided on the vertically placed decorative strip body, a through-hole is provided inside the recess, and a decoration block is provided on the recess.

12. The easy-to-lay floor board as claimed in claim 8, characterized in that the upper surface of the decorative strip body has a cambered surface, and an insertion slot is formed between one side of the cambered surface and the tongue-shaped hooking tongue.

* * * * *